United States Patent [19]

Oliff et al.

[11] 4,190,149

[45] Feb. 26, 1980

[54] ARTICLE CARRIER AND BLANK THEREFOR

[75] Inventors: James R. Oliff, Austell; Richard K. Watkins, Lithonia, both of Ga.

[73] Assignee: The Mead Corporation, Dayton, Ohio

[21] Appl. No.: 11,481

[22] Filed: Feb. 12, 1979

[51] Int. Cl.[2] ..... B65D 85/62

[52] U.S. Cl. ..... 206/145; 206/147; 206/148; 206/161; 229/32; 294/87.2

[58] Field of Search ..... 206/151, 145, 429, 153, 206/427, 147, 161, 194, 148; 229/32; 294/87.2

[56] References Cited

U.S. PATENT DOCUMENTS

| | | | |
|---|---|---|---|
| 205,531 | 7/1878 | Donahue | 229/32 |
| 2,798,603 | 7/1957 | Grinspoon | 206/429 |
| 3,156,358 | 11/1964 | Randrup | 206/153 |

FOREIGN PATENT DOCUMENTS

| | | | |
|---|---|---|---|
| 505679 | 5/1920 | France | 229/32 |

*Primary Examiner*—William T. Dixson, Jr.
*Attorney, Agent, or Firm*—Walter M. Rodgers; Walter A. Rodgers

[57] ABSTRACT

An article carrier formed from a unitary blank comprises a top wall (1) with side (2,3) and end walls (6,7) depending downwardly and generally outwardly therefrom, multiple neck receiving apertures (16–21) together with finger gripping apertures (10,11) formed in the top wall, and an overlapping web panel (22,23,26,27) and anchoring tabs (30,31,34,35) foldably joined to the end edges of the side and end walls and secured together at each corner of the carrier.

6 Claims, 2 Drawing Figures

ARTICLE CARRIER AND BLANK THEREFOR

TECHNICAL FIELD

This invention relates to a top gripping article carrier by which packaged articles are held securely in place and which requires a limited amount of paperboard material.

BACKGROUND ART

Article carriers of the so-called top gripping type are generally known. Since this type of carrier does not provide an amount of packaging material around the main bodies of the packaged articles, the articles often tend to move relative to each other when transported. Of course this compromises carrier integrity due to undesirable and excessive article contact.

DISCLOSURE OF INVENTION

An article carrier is formed from a unitary blank and comprises a top wall with side and end walls diverging downwardly therefrom, multiple neck receiving apertures formed in the top wall, and corner structure interconnecting the side and end walls at each corner of the carrier and conforming to the contour of the associated packaged article.

BEST MODE OF CARRYING OUT THE INVENTION

Figure 1:
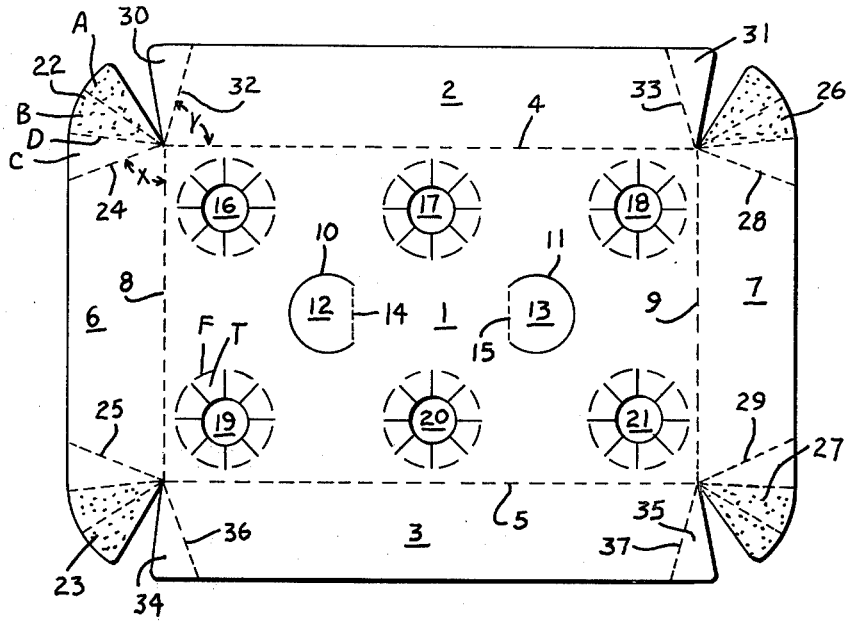
FIG. 1 is a plan view of a blank from which the carrier is formed according to this invention and FIG. 2 is an isometric view of a completed carrier with the articles disposed therein.

In the drawing the numeral 1 designates the top wall of the carrier to the side edges of which side walls 2 and 3 are foldably joined respectively along fold lines 4 and 5. In addition end walls 6 and 7 are foldably joined respectively to the end edges of top wall 1 along fold lines 8 and 9.

In order to facilitate transport of the carrier, finger gripping apertures 10 and 11 are formed in top wall 1 and are defined by finger cushioning flaps 12 and 13 which are foldably joined to top wall 1 respectively along fold lines 14 and 15.

For the purpose of receiving the necks of the packaged articles, neck receiving apertures 16, 17, 18, 19, 20, and 21 are provided and are formed in top wall 1. To prevent the packaged articles from slipping through the respective neck receiving apertures, each neck receiving aperture is provided with multiple bottle engaging tabs T which are foldably joined to top wall 1 along the associated fold line F.

According to a feature of this invention, web panels 22 and 23 are foldably joined to the end edges of end wall 6 respectively along fold lines 24 and 25. Likewise web panels 26 and 27 are foldably joined respectively to the end edges of end wall 7 along fold lines 28 and 29. To complete the basic corner structure of the carrier, anchoring tabs 30 and 31 are provided and are foldably joined respectively to the end edges of side wall 2 along fold lines 32 and 33 and anchoring tabs 34 and 35 are foldably joined respectively to the end edges of side wall 3 along fold lines 36 and 37. Finally each web panel is provided with web sections A, B, and C.

In order to set up the carrier from the blank shown in FIG. 1, initially it is necessary to fold end walls 6 and 7 downwardly along fold lines 8 and 9 respectively. Web sections A and B of each web panel are then folded downwardly, as viewed in FIG. 1, along fold line D through an angle of approximately 90°. Then an application of glue is made to each of the web panels 22, 23, 26, and 27 as indicated by stippling in FIG. 1. Thereafter side walls 2 and 3 are folded downwardly along fold lines 4 and 5 respectively into positions whereby anchoring tabs 30, 34, 31, and 35 are secured in an overlapping relationship respectively with web panels 22, 23, 26, and 27.

According to a feature of this invention, each of the side walls 2 and 3 and end walls 6 and 7 are folded through an angle less than 90° whereby each wall is disposed in a downwardly diverging relationship with respect to top wall 1. Since the angles X and Y shown in FIG. 1 in connection with web panel 22 and anchoring tab 30 respectively are acute, the associated end and side walls are maintained in a downwardly diverging relationship with respect to top wall 1. Of course the same angular relationships exist at the other corners of the carrier.

Figure 2:
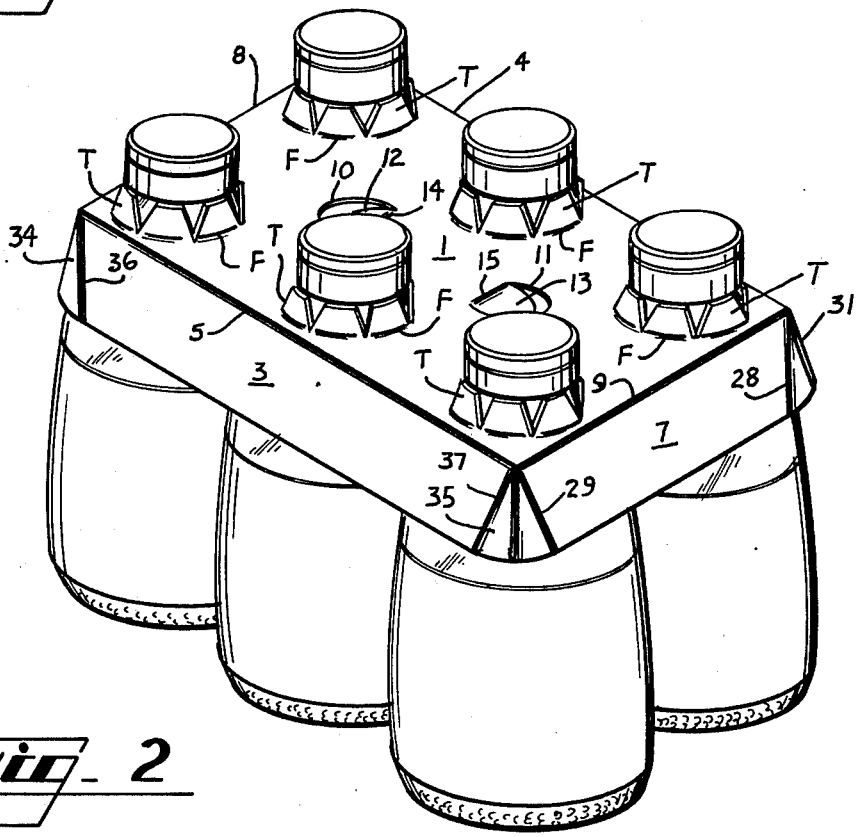

After the folding and glueing operations are completed, the carrier is lowered onto the appropriate number of bottles so that the necks of the bottles enter neck receiving apertures 16–21 and the end of each bottle engaging tab T is disposed in abutting relationship with the lower portion of the associated bottle cap, as shown in FIG. 2. Formation and loading of the article carrier according to this invention is then completed.

According to this invention, as a carrier is lowered onto the bottles, each corner structure of the carrier is caused to become somewhat rounded to conform to the contour of the bottle disposed in the associated corner of the carrier as best shown in FIG. 2. More specifically anchoring tabs 30, 31, 34, and 35 are disposed in coincidence with web section B of the respective web panels 22, 26, 23, and 27. In order for the corners of the carrier to form the necessary rounded conformation, each of the web sections A, B, and C and associated anchoring tabs 30, 31, 34, and 35 form an appropriate angular relationship with respect to each other and with adjacent portions of the blank as determined by the particular shape of the packaged bottle. As a result the bottles are restrained from inadvertent movement and possible breakage.

Since this carrier can be applied to the articles without complicated folding and glueing, it is easily applied to the articles by machine or manually as necessary. In addition since the side and end walls of the carrier diverge downwardly from the top wall, the carrier can be easily nested with an adjacent carrier which facilitates storage and reduces transportation costs.

INDUSTRIAL APPLICABILITY

By this invention an article carrier is provided which is extremely economical and at the same time functions to hold the packaged articles securely in the proper relative positions.

We claim:

1. A top gripping article carrier blank comprising a top wall (1), a pair of side walls (2,3) foldably joined respectively to the side edges of said top wall, a pair of end walls (6,7) foldably joined respectively to the end edges of said top wall, multiple neck receiving apertures (16–21) formed in said top wall, and characterized by a web panel (22,23,26,27) foldably joined to each end edge of each wall of one pair of walls along a fold line disposed at an acute angle to the fold line between the associated wall and said top wall, an anchoring tab (30,31,34,35) joined to each end edge of each wall of the other pair of walls along a fold line disposed at an acute angle to the fold line between the associated wall and said top wall, the outer edge of each of said anchoring tabs disposed at an obtuse angle with respect to the fold line between the associated wall of said other pair of walls and said top wall, and said anchoring tabs being spaced respectively from the associated web panel.

2. An article carrier blank according to claim 1 and further characterized by multiple bottle engaging tabs (T) formed on the peripheries of said neck receiving apertures.

3. An article carrier blank according to claim 1 and further characterized by a pair of finger gripping apertures (10,11) formed in said top wall.

4. An article carrier comprising a top wall (1), a pair of side walls (2,3) foldably joined respectively to the side edges of said top wall and diverging downwardly therefrom, a pair of end walls (6,7) foldably joined respectively to the end edges of said top wall and diverging downwardly therefrom, multiple neck receiving apertures (16–21) formed in said top wall, and characterized by a web panel (22,23,26,27) foldably joined to each end edge of each wall of one of said pairs of walls, an anchoring tab foldably joined to each end edge of each wall of the other of said pairs of walls, each web panel secured in overlapping face contacting relation with the corresponding one of said anchoring tabs, each fold line between said web panels and said anchoring tabs and said walls disposed at an acute angle to the associated edge of said top wall, each of said web panels comprising web sections (A,B,C), a first web section foldably joined to the associated one of said walls, a second web section foldably joined to said first web section remote from said associated wall, a third web section foldably joined to said second web section remote from said first web section, each of said anchoring tabs disposed respectively in coincidence with said second web section of the corresponding web panel and secured thereto, and said third web section being secured to the associated one of the other of said pairs of walls.

5. An article carrier according to claim 4 and further characterized by multiple bottle engaging tabs (T) formed on the periphery of each of said neck receiving apertures.

6. An article carrier according to claim 4 and further characterized by a pair of finger gripping apertures (10,11) formed in said top wall.

* * * * *